US005957285A

United States Patent [19]

Lai

[11] Patent Number: 5,957,285

[45] Date of Patent: Sep. 28, 1999

[54] TOOL BOX

[76] Inventor: Jin-Tsai Lai, No. 54, Shi Hu Road, Shi Hu Tsuen, Ta Li Hsiang, Taichung Hsien, Taiwan

[21] Appl. No.: 09/084,341

[22] Filed: May 26, 1998

[51] Int. Cl.[6] ..... B65D 85/20

[52] U.S. Cl. ..... 206/372; 206/373

[58] Field of Search ..... 206/370, 372, 206/373, 234, 485

[56] References Cited

U.S. PATENT DOCUMENTS 5,526,929 6/1996 Wei ..... 206/372 X 5,676,254 10/1997 Cheng et al. ..... 206/373 X

*Primary Examiner*—Jacob K. Ackun

*Attorney, Agent, or Firm*—Rosenberg, Klein & Bilker

[57] ABSTRACT

A tool box includes a base portion having a bottom 10 and four peripheral walls extending from a periphery of the bottom, two flanges extending from two opposite sides of the bottom and each of the flanges 13 having a plurality of notches. A first part and a second part are pivotally connected with each other at respective first ends thereof. The first part and the second part each have a plurality of recesses defined therein. The first part has two stubs extending from two sides of a second end thereof so as to be received in two opposite notches.

6 Claims, 8 Drawing Sheets

TOOL BOX

BACKGROUND OF THE INVENTION

1. Field of the Invention

The present invention relates to a tool box comprising two pivotally connected parts which are received in a box, the box having a plurality of notches defined in two opposite sides of a bottom thereof and each of the parts having two stubs extending therefrom so that the two parts can stand on the bottom by receiving the stubs in the notches.

2. Brief Description of the Prior Art

Tool boxes have a plurality of types of design and each of the types has its own feature to meet a specific requirement of users. Nevertheless, a small tool box generally provides a very limited feature which simply involves a plurality of recesses defined therein for tools received in the recesses. That is to say, a user has to face downwardly to the tool box on a table to find out a tool he/she needs. It is inconvenient for the user to pick a tool in the recess of the tool box on a horizontal surface. Furthermore, some work needs the user concentrate his/her mind on the workpiece so that it is therefore inconvenient for the user to turn his/her head from the workpiece.

The present invention provides an improved tool box which has two parts and the two parts can stand upwardly so that tools in the two parts are easily to be picked by a user without facing downwardly to the tool box. By the tool box of the present invention, the problems as mentioned above are mitigated.

SUMMARY OF THE INVENTION

In one aspect of the present invention, there is provided a tool box comprising a base portion having a bottom and four peripheral walls extending from a periphery of the bottom, two pivotally connected parts received in the base portion. The bottom has two flanges extending from two opposite sides thereof and each of the flanges has a plurality of notches defined therein. Each of the two parts has a plurality of recesses defined therein and at least one of the two parts has two stubs extending from two sides thereof so that the two stubs are received in two of the notches.

It is an object of the present invention to provide a tool box having two parts received therein wherein the two parts are able to stand when in use.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
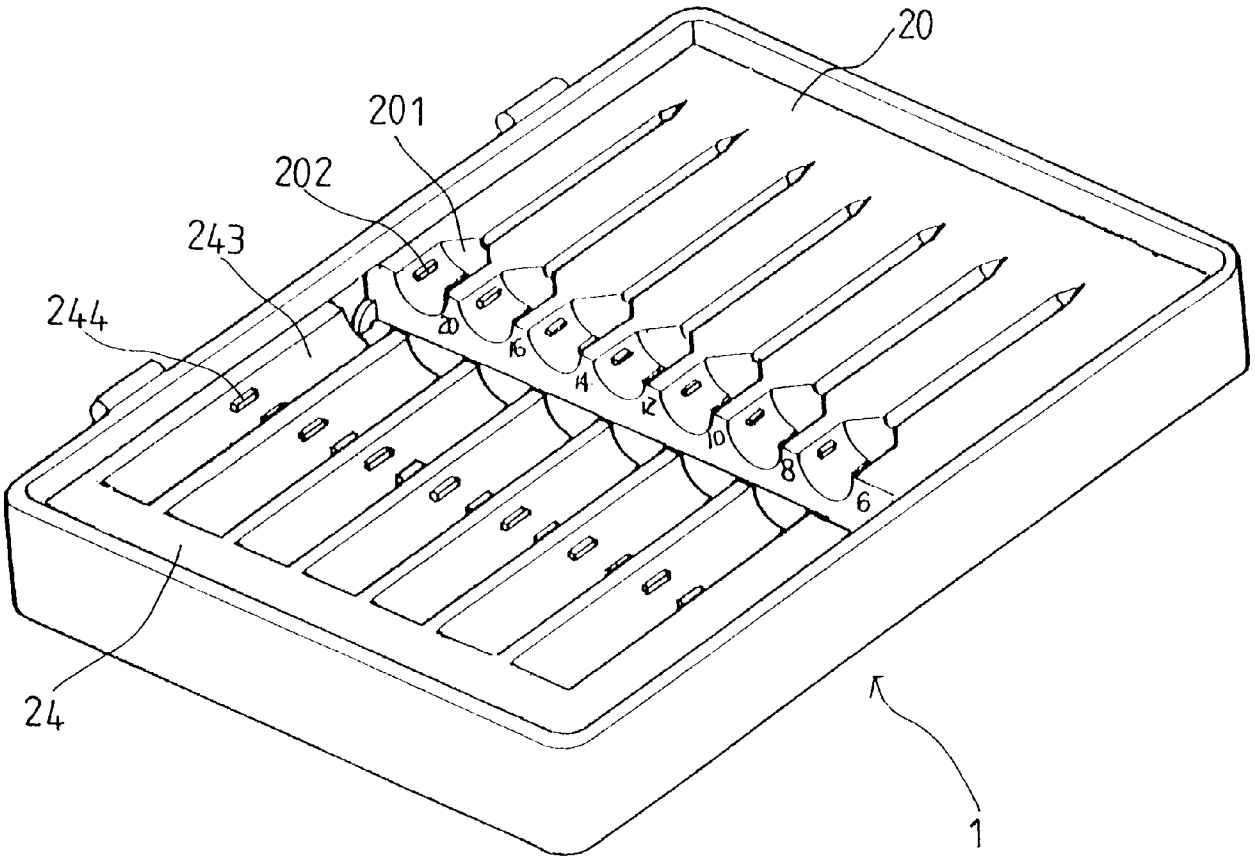
FIG. 1 is a perspective view of a tool box in accordance with the present invention.
Figure 2:
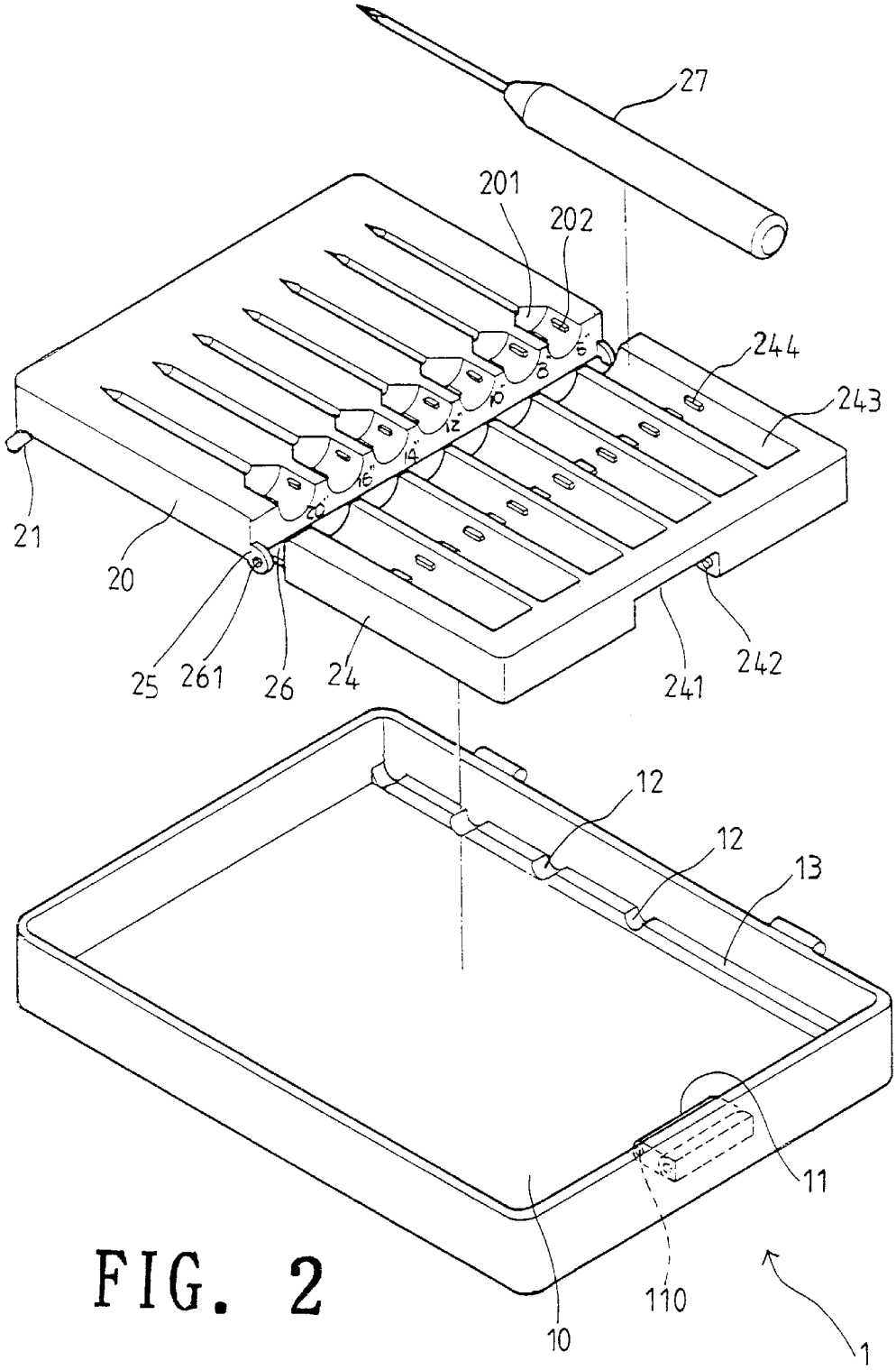
FIG. 2 is an exploded view of the tool box in accordance with the present invention.
Figure 3:
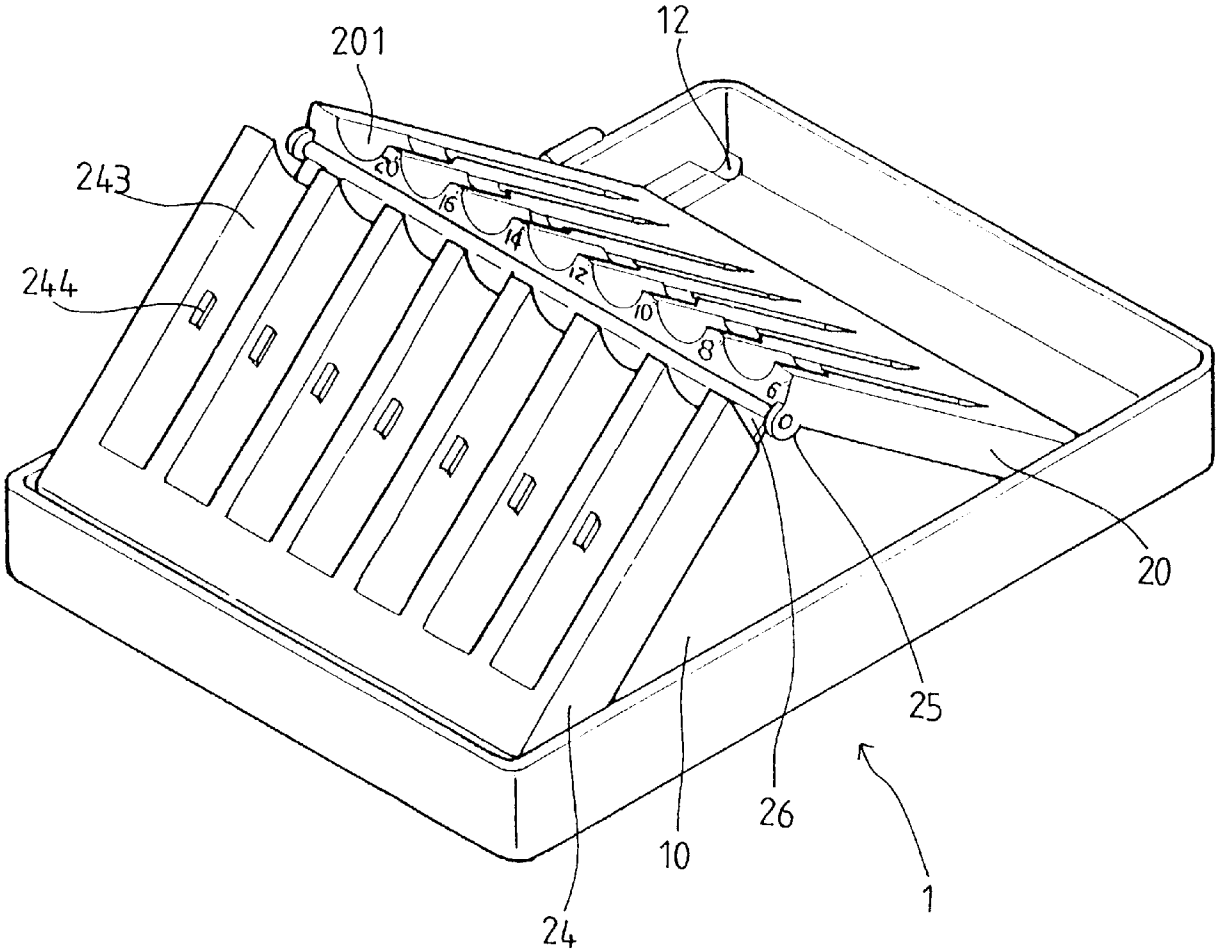
FIG. 3 is a perspective view of the tool box when two parts in the tool box stand.

Referring to the drawings and initially to FIGS. 1 through 3, a tool box in accordance with the present invention generally includes a base portion 1 having a bottom 10 and four peripheral walls extending from a periphery of the bottom 10, a cover (not shown) pivotally mounted to the base portion 1, and a first part 20 and a second part 24 both received in the base portion 1. The bottom 10 has two flanges 13 extending from two opposite sides thereof and each of the flanges 13 has a plurality of notches 12 defined therein. A block 11 extends from one of two inner ends of the base portion 1 and has two apertures 110 defined in two opposite sides thereof.

The first part 20 has two lugs 25 extending from a first end thereof and each of the lugs 25 has a hole defined therethrough. The second part 24 has a plate 26 extending from a first end thereof and the plate 26 has two pin members 261 extending from two opposite ends thereof so as to be pivotally received in the holes of the two lugs 25 so that the first part 20 and a second part 24 are pivotally connected with each other at respective first ends thereof. Each of the first part 20 and the second part 24 has a plurality of recesses 201/243 defined therein. Each of the recesses 201/243 has two protrusions 202/244 extending from an inner periphery defining the recess 201/243 so as to securely positioning a tool 27 therein.

The first part 20 has two stubs 21 extending laterally from two sides of a second end thereof so that the two stubs 21 are received in two of the notches 12. The second part 24 has an opening 241 defined in an underside of a second end thereof, two bosses 242 extending from two opposite sides of a periphery defining the opening 241 so as to be pivotally received in the apertures 110 of the block 11.

Figure 4:
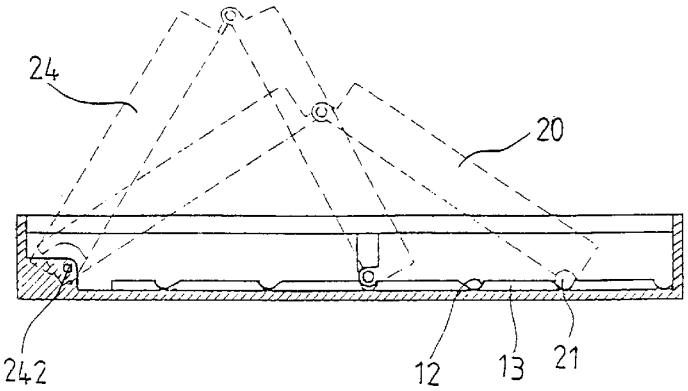
FIG. 4 is a side view to illustrate two different positions of the two parts when standing upright.
Figure 8:
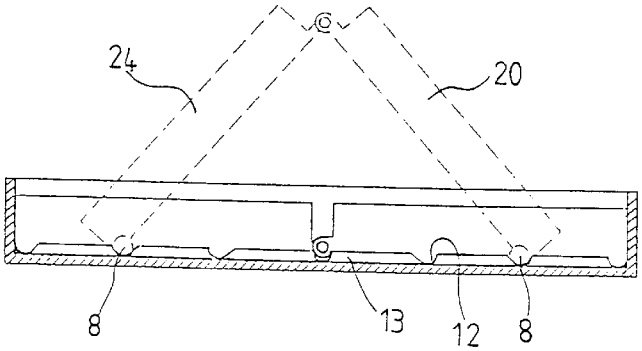
FIGS. 8 and 9 are side view to illustrate the two status as shown in FIGS. 6 and 7.
Figure 9:
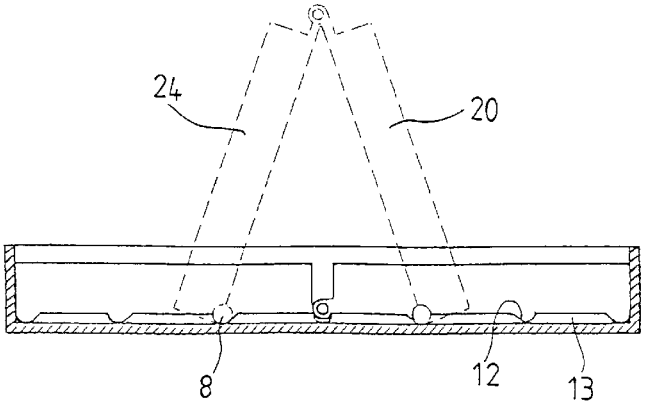
Figure 5:
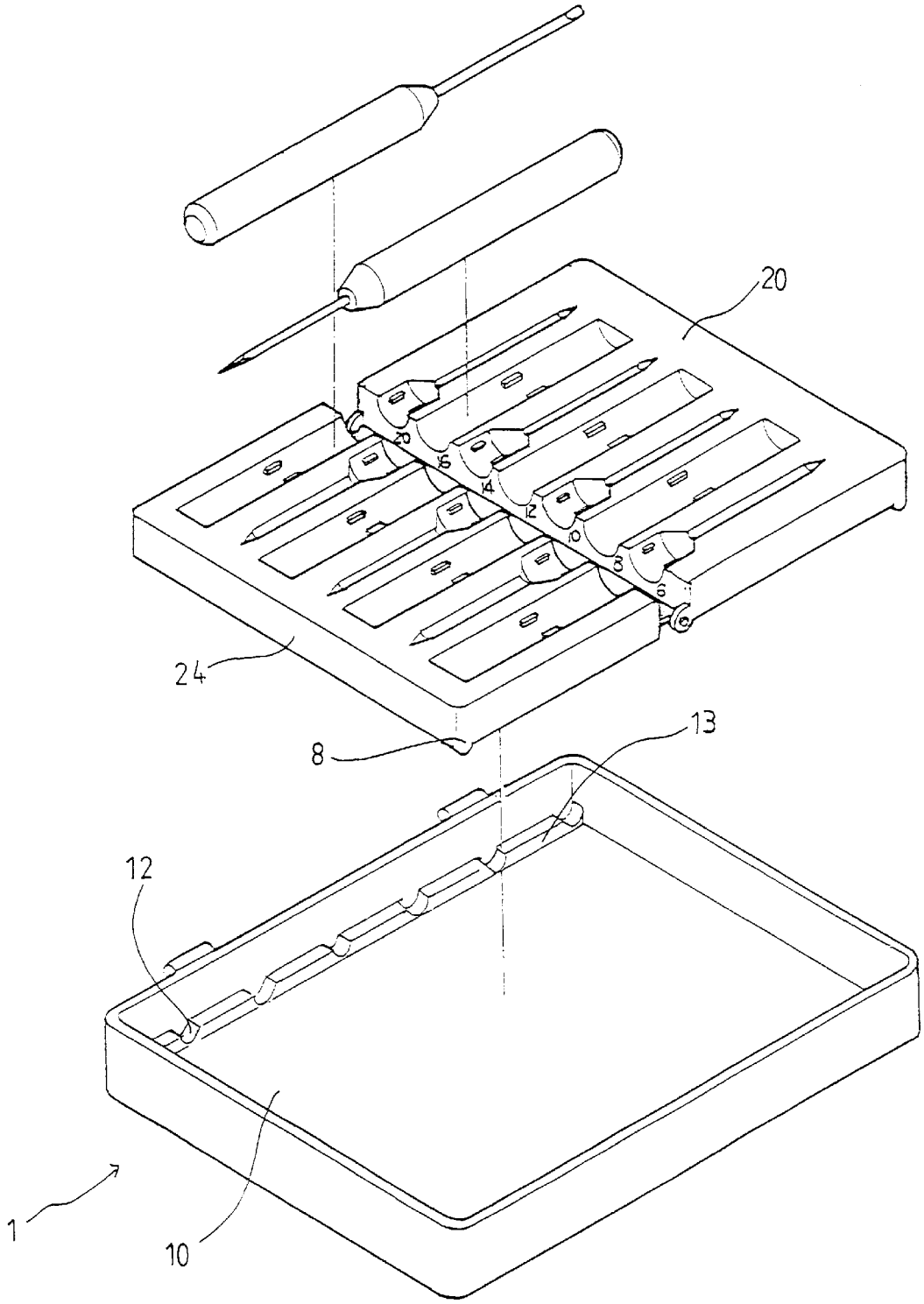
FIG. 5 is an exploded view to show another embodiment of the tool box of the present invention.
Figure 7:
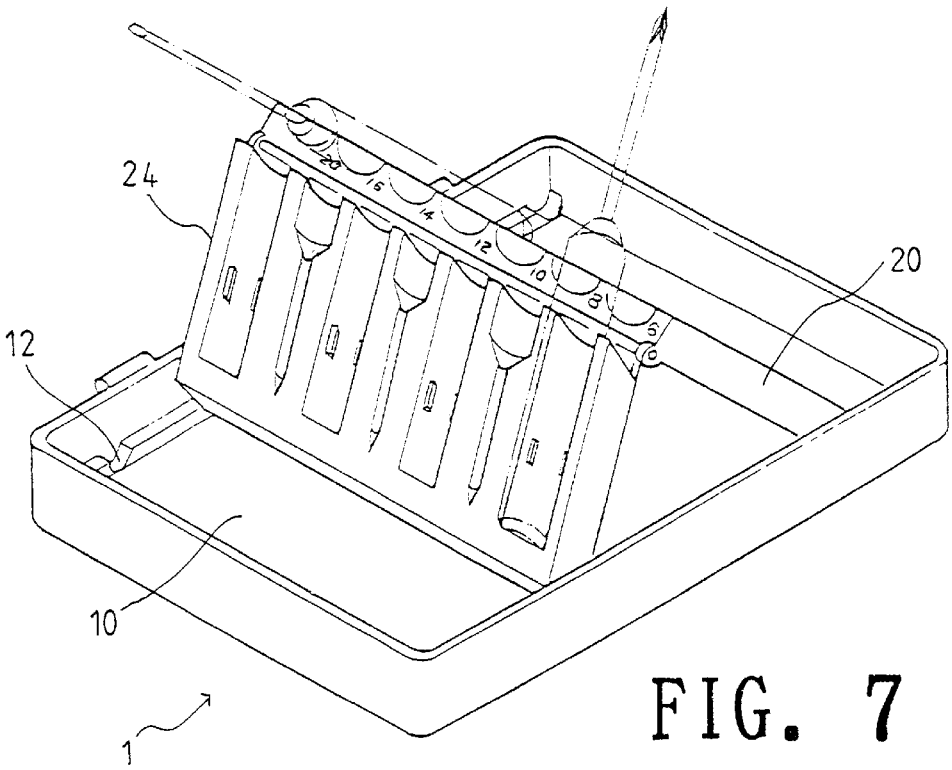
FIGS. 6 and 7 are perspective view to illustrate two different positions of the two parts shown in FIG. 5 when standing upright.
Figure 6:
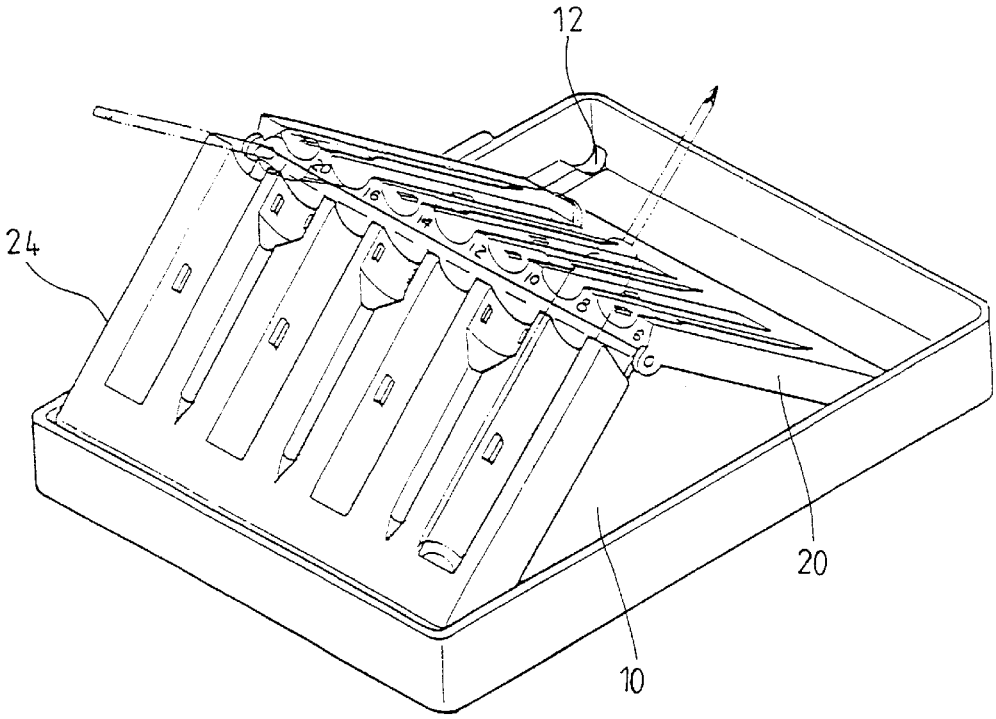

When in use, the first part 20 is able to be pivoted about the two pin members 261 and the second part 24 is pivoted about the two bosses 242 so that both the first part 20 and the second part 24 are able to stand on the bottom 10 with the two stubs 21 received in two opposite notches 12 of the two flanges 13. Therefore, tools 27 can be easily picked and identified by a user. Referring to FIG. 4, the positions of the first part 20 can be adjusted according to needs by receiving the two stubs 21 into notches 12 of the flanges 13.

Referring to FIGS. 5 through 9, each of the first part 20 and the second part 24 may has a ridge 8 extending from an underside of the second end thereof so that the two ridges 8 of the two parts 20, 24 are able to be received in two opposite notches 12 of the two flanges 13. In this embodiment, the two parts 20, 24 can respectively stand by adjusting their ridges 8 in two of the notches 12.

Figure 10:
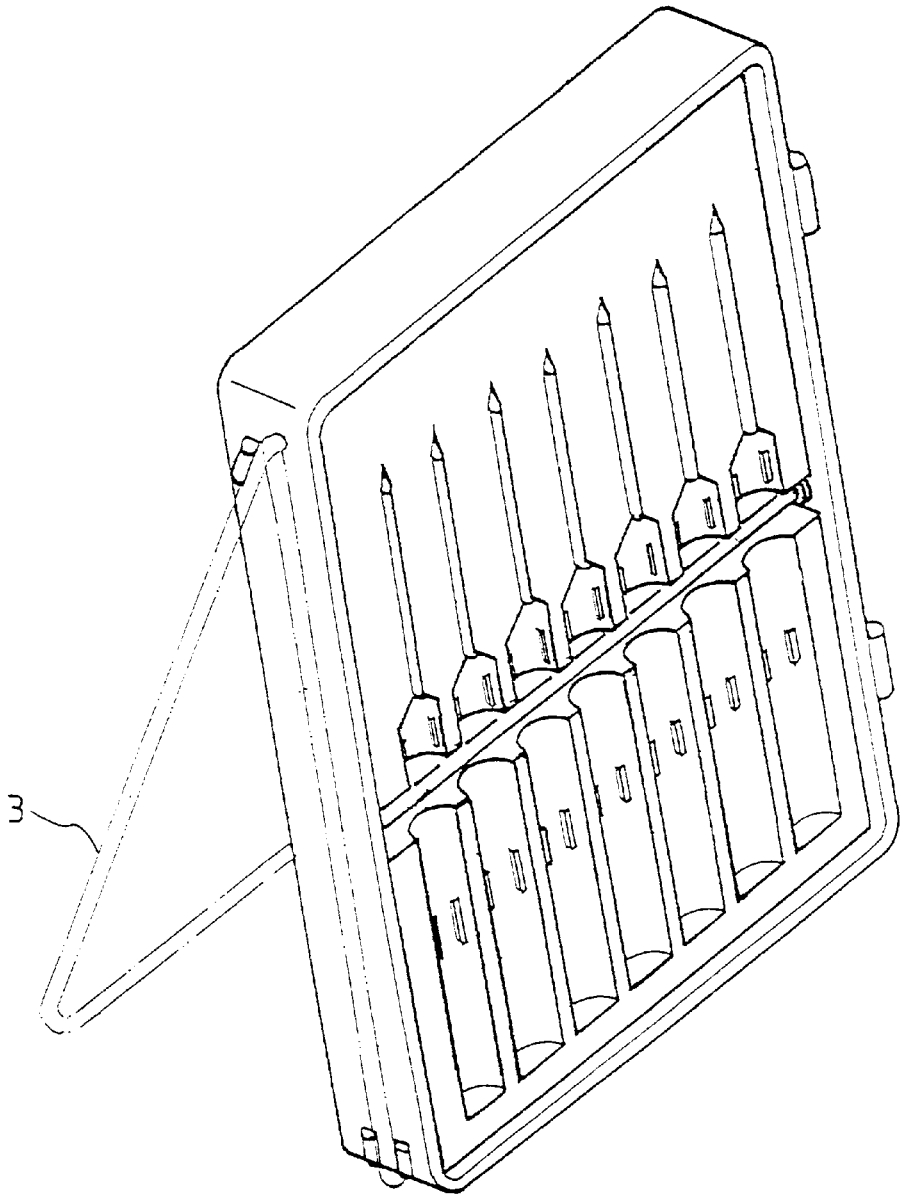
FIG. 10 is a perspective view of the tool box of accordance with the present invention and a stand attached thereto.
Figure 11:
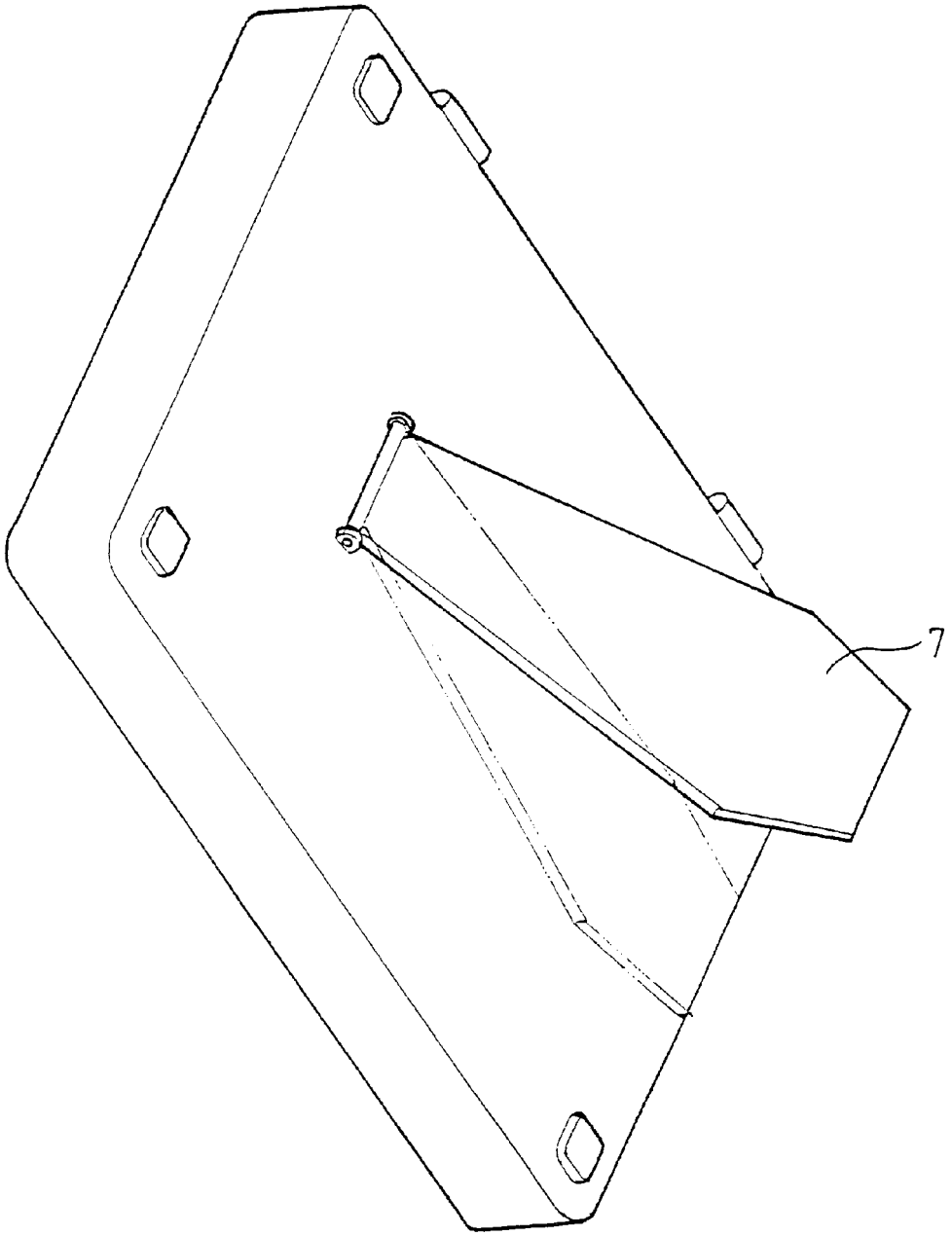
FIG. 11 is a perspective view of the tool box of accordance with the present invention and another stand attached to an underside of the tool box.

Referring to FIG. 10, the tool box further has a U-shaped stand 3 with two ends thereof pivotally connected to two sides thereof so that when using the tool box, the U-shaped stand 3 can be pulled away from the base portion 1 to support the tool box on a surface. FIG. 11 shows another embodiment of the stand 7 which is an elongate board and directly and pivotally connected to an underside side of the tool box.

While particular embodiments of the present invention have been illustrated and described herein, it is not intended to limit the invention and changes and modifications may be made therein within the scope of the invention as hereinafter claimed.

What is claimed is:

1. A tool box comprising:

a base portion having a bottom and four peripheral walls extending from a periphery of said bottom, said bottom having two flanges extending from two opposite sides thereof and each of said flanges having a plurality of notches defined therein, and a first part and a second part pivotally connected with each other at respective first ends thereof, said first part and said second part being received in said base portion and each having a plurality of recesses defined therein, at least one of said first part and said second part having two stubs extending from two sides of a second end thereof so that said two stubs are received in two of said notches.

2. The tool box as claimed in claim 1 wherein said two stubs extend laterally from said two sides of said second end of said first part.

3. The tool box as claimed in claim 1 further comprising a block extending from one of two inner ends of said base portion and said block having two apertures defined in two opposite sides thereof, said second part having an opening defined in an underside of said second end thereof, two bosses extending from two opposite sides of a periphery defining said opening so as to be pivotally received in said apertures.

4. The tool box as claimed in claim 1 further comprising a ridge extending from an underside of a second end of one of said first part and said second part, said ridge received in two opposite notches of the two flanges.

5. The tool box as claimed in claim 1 wherein said first part has two-lugs extending from said first end thereof and each of said lugs has a hole defined therethrough, said second part having a plate extending from said first end thereof and said plate having two pin members extending from two opposite ends thereof so as to be pivotally received in the holes of the two lugs.

6. The tool box as claimed in claim 1 wherein each of said recesses has two protrusions extending from an inner periphery defining said recess.

* * * * *